US007270400B2

(12) United States Patent
Koguchi et al.

(10) Patent No.: US 7,270,400 B2
(45) Date of Patent: Sep. 18, 2007

(54) INK JET RECORDING METHOD

(75) Inventors: Hideyuki Koguchi, Kanagawa (JP); Seiichi Inoue, Kanagawa (JP)

(73) Assignee: Fujifilm Corporation, Tokyo (JP)

( * ) Notice: Subject to any disclaimer, the term of this patent is extended or adjusted under 35 U.S.C. 154(b) by 304 days.

(21) Appl. No.: 11/131,427

(22) Filed: May 18, 2005

(65) Prior Publication Data

US 2005/0259132 A1 Nov. 24, 2005

(30) Foreign Application Priority Data

May 18, 2004 (JP) ..... 2004-147714

(51) Int. Cl.
*B41J 2/06* (2006.01)

(52) U.S. Cl. ..... 347/55

(58) Field of Classification Search ..... 347/54–55
See application file for complete search history.

(56) References Cited

U.S. PATENT DOCUMENTS 4,314,263 A 2/1982 Carley
6,158,844 A 12/2000 Murakami et al.
2005/0046675 A1* 3/2005 Aoshima ..... 347/55
2005/0200657 A1* 9/2005 Nakazawa ..... 347/55
2005/0200658 A1* 9/2005 Furukawa ..... 347/55
2005/0237373 A1* 10/2005 Koguchi et al. ..... 347/112

FOREIGN PATENT DOCUMENTS

EP 0 764 529 A2 3/1997
JP 10-138493 A 5/1998
JP 2002-370364 A 12/2002

* cited by examiner

*Primary Examiner*—Huan Tran
(74) *Attorney, Agent, or Firm*—Sughrue Mion Pllc.

(57) ABSTRACT

The ink jet recording method allows an electrostatic force to act on an ink composition containing at least charged particles containing a colorant and a dispersion medium to form a thread of the ink composition, and divides the thread into small portions to eject ink droplets on a recording medium. A first average concentration of the charged particles contained in the thread from its tip end portion to its central portion is higher than a second average concentration of the charged particles contained in a whole thread. And/or, a first force acting on the charged particles contained in the thread is made larger than a second force obtained by subtracting the first force acting on the charged particles contained in the thread from a second force acting on a whole thread.

13 Claims, 4 Drawing Sheets

INK JET RECORDING METHOD

This application claims priority on Japanese patent application No. 2004-147714, the entire contents of which are hereby incorporated by reference. In addition, the entire contents of literatures cited in this specification are incorporated by reference. In addition, the entire contents of literatures cited in this specification are incorporated by reference.

BACKGROUND OF THE INVENTION

The present invention relates to an ink jet recording method in which ink droplets are ejected by causing an electrostatic force to act on an ink composition containing at least charged particles containing a colorant and a dispersion medium.

In electrostatic ink jet recording, an ink composition (hereinafter referred to as "ink") obtained by dispersing charged fine particles containing a colorant (hereinafter referred to as "colorant particles") in a medium is used, and predetermined voltages are respectively applied to ejection portions of an ink jet head in accordance with image data, whereby the ink is ejected and controlled by utilizing electrostatic forces to record an image corresponding to the image data on a recording medium.

Known as an example of an electrostatic ink jet recording apparatus is an ink jet recording apparatus disclosed in JP 10-138493 A.

FIG. 4 is a schematic view showing an ink jet head of the electrostatic ink jet recording apparatus disclosed in JP 10-138493 A.

The ink jet head 80 includes a head substrate 82, ink guides 84, an insulating substrate 86, control electrodes 88, an electrode substrate 90, a D.C. bias voltage source 92, and a pulse voltage source 94.

Ejection ports (through holes) 96 through which ink is to be ejected are formed so as to extend perfectly through the insulating substrate 86. The head substrate 82 is provided so as to extend in a direction of disposition of the ejection ports 96, and the ink guides 84 are disposed in positions on the head substrate 82 corresponding to the ejection ports 96. Each ink guide 84 extends perfectly through the ejection port 96 so as for its tip portion 84*a* to project upwardly and beyond the surface of the insulating substrate 86 on an opposite side to the head substrate 82.

The head substrate 82 is disposed at a predetermined distance from the insulating substrate 86. Thus, a passage 98 for ink Q is defined between the head substrate 82 and the insulating substrate 86.

The ink Q containing fine particles (colorant particles) which are charged at the same polarity as that of a voltage applied to the control electrodes 88 is circulated through the ink passage 98 for example from the right-hand side to the left-hand side in FIG. 4, by a circulation mechanism for ink (not shown). Thus, the ink Q is supplied to the corresponding ones of the ejection ports 96.

The control electrode 88 is provided in a ring-like shape on the surface of the insulating substrate 86 on the side of the recording medium P so as to surround the ejection port 96. In addition, the control electrode 88 is connected to the pulse voltage source 94 for generating a pulse voltage in accordance with image data. The pulse voltage source 94 is grounded through the D.C. bias voltage source 92.

In the electrostatic ink jet recording, a recording medium P is preferably held on an insulating layer 91 of the grounded electrode substrate 90 with the recording medium P being charged to a high voltage opposite in polarity to that applied to the control electrode by a charging device utilizing a scorotron charger or the like.

In the electrostatic ink jet recording described above, when no voltage is applied to the control electrode 88, the Coulomb attraction between the bias voltage applied to the counter electrode and the electric charges of the colorant particles in the ink Q, the viscosity of the ink (dispersion medium), the surface tension, the repulsion among the charged particles, the fluid pressure when the ink is supplied, and the like operate in conjunction with one another. Thus, the balance is kept in a meniscus shape as shown in FIG. 4 in which the ink Q slightly rises from the ejection port (nozzle) 96.

In addition, the colorant particles migrate to move to the meniscus surface due to the Coulomb attraction or the like. In other words, the ink Q is concentrated on the meniscus surface.

When the voltage is applied to the control electrode 88 (ejection is valid), the drive voltage is superposed on the bias voltage so that the ink Q is attracted toward the side of the recording medium P (counter electrode) to form a nearly conical shape, i.e., a so-called Taylor cone.

When time elapses after the start of application of the voltage to the control electrode 88, the balance between the Coulomb attraction acting on the colorant particles and the surface tension of the dispersion medium is broken. As a result, there is formed a slender ink liquid column having a diameter of about several microns to several tens of microns which is called a thread. When time further elapses, as disclosed in U.S. Pat. No. 4,314,263 or the like, a tip portion of the thread is divided into small portions, and as a result, droplets of the ink Q are ejected to fly toward the recording medium P.

In the electrostatic ink jet recording, usually, a modulated pulse voltage is applied to the corresponding ones of the control electrodes 88 to turn ON/OFF the corresponding ones of the control electrodes 88 to modulate and eject ink droplets. Thus, the ink droplets are ejected on demand in accordance with an image to be recorded.

JP 2002-370364 A discloses a method of ejecting ink droplets in which the Coulomb force acting on colorant particles in ink and the dielectric polarization force acting on a solvent are controlled to adjust the content of the colorant particles in ink droplets to be ejected thereby achieving compatibility among the recording density, brightness of an image, fixing property, responsivity and the like.

In such electrostatic ink jet recording, when ejection electrodes can be created so as to correspond to ejection portions, independent ink flow paths, partition walls, and the like for separating the ejection portions from each other may be omitted. In this case, a so-called nozzleless structure is obtained, so it becomes possible to achieve cost reduction of the ink jet head and the like and to improve yields. In addition, with the structure described above, even when a problem such as ink clogging has occurred in the ejection portions, it becomes possible to achieve recovery from the trouble through simple processing.

On the other hand, various factors such as properties of an ink composition, properties of a head and a drive voltage affect the electrostatic ink jet recording, which makes the formation of a thread and its division into small portions unstable. The ejection of ink droplets and their landing positions, and the concentration of ink (amount of colorant particles with respect to a dispersion medium) are thus made unstable and an image having the desired image quality cannot be obtained in a consistent manner.

It is possible to improve the recording density, brightness of an image, fixing property, responsivity and the like by adjusting the content of colorant particles in ink droplets to be ejected through control of the Coulomb force acting on the colorant particles and the dielectric polarization force acting on a solvent as in JP 2002-370364 A. However, the formation of a thread and its division into small portions were not stable and the desired image quality could not be attained in a consistent manner.

SUMMARY OF THE INVENTION

The present invention has been made in order to solve the problems described above and an object of the present invention is to provide an electrostatic ink jet recording method which allows ink droplets obtained through formation of threads and their division into small portions to be ejected stably in the electrostatic ink jet recording, and the diameter and density of each dot on a recording medium to be stabilized and adjusted, thereby obtaining the stable ink droplets and achieving high gradation resolving power, and which is capable of consistently recording a high-quality image.

In order to attain the object described above, the first aspect of the invention provides an ink jet recording method comprising the steps of allowing an electrostatic force to act on an ink composition containing at least charged particles containing a colorant and a dispersion medium to form a thread of the ink composition, and dividing the thread into small portions to eject ink droplets on a recording medium, wherein a first average concentration of the charged particles contained in the thread from its tip end portion to its central portion is higher than a second average concentration of the charged particles contained in a whole thread.

Also, the second aspect of the invention provides an ink jet recording method comprising the steps of allowing an electrostatic force to act on an ink composition containing at least charged particles containing a colorant and a dispersion medium to form a thread of the ink composition, and dividing the thread into small portions to eject ink droplets on a recording medium, wherein a first force acting on the charged particles contained in the thread is made larger than a second force obtained by subtracting the first force acting on the charged particles contained in the thread from a second force acting on a whole thread.

Further, the third aspect of the invention provides an ink jet recording method comprising the steps of allowing an electrostatic force to act on an ink composition containing at least charged particles containing a colorant and a dispersion medium to form a thread of the ink composition, and dividing the thread into small portions to eject ink droplets on a recording medium, wherein a first average concentration of the charged particles contained in the thread from its tip end portion to its central portion is higher than a second average concentration of the charged particles contained in a whole thread, and a first force acting on the charged particles contained in the thread is made larger than a second force obtained by subtracting the first force acting on the charged particles contained in the thread from a second force acting on the whole thread.

Preferably, in any of the aspects described above, a first electric conductivity of the charged particles contained in the ink composition is 50% or higher but lower than 100% of a second electric conductivity of the ink composition.

Preferably, a ratio of a first electric conductivity of the charged particles to a value obtained by subtracting the first electric conductivity of the charged particles from a second electric conductivity of the ink composition is 1 or higher.

Preferably, the charged particles contained in the ink composition has a volume mean diameter of 0.2 to 5.0 μm.

Preferably, the charged particles contained in the ink composition has an amount of charge in a range of 5 to 200 μC/g.

Preferably, the ink composition has a viscosity at 20° C. in a range of 0.1 to 10 mPa·s.

According to the present invention having the above configuration, since the formation of threads and their division into small portions are stably performed in the electrostatic ink jet recording, ink droplets are stably ejected and a dot of a desired diameter can be formed at a desired ink concentration in image recording, whereby a high-quality image can be recorded in a consistent manner. According to the present invention, it is also possible to control as required the ink concentration and the dot diameter by the pulse width modulation thereby recording a high-quality image having a higher gradation resolving power in a more consistent manner.

It is also possible to improve the drive frequency because the ejection responsivity of ink droplets with respect to the application of a drive voltage is enhanced.

DETAILED DESCRIPTION OF THE INVENTION

An ink jet recording method of the present invention will hereinafter be described in detail on the basis of a preferred embodiment shown in the accompanying drawings.

Figure 1A:
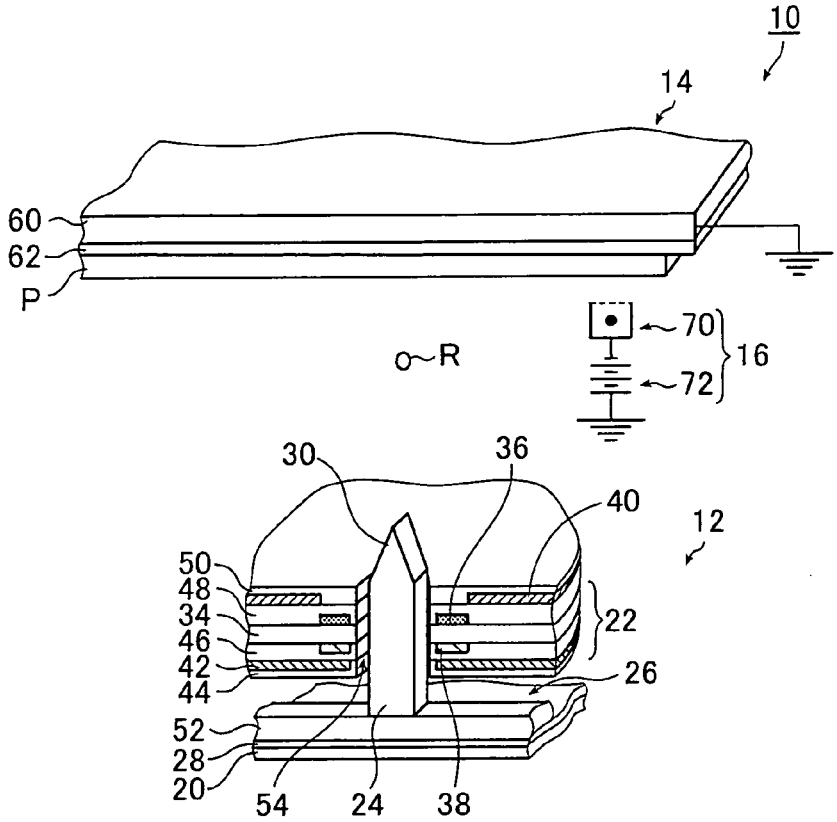
FIGS. 1A and 1B are conceptual views of an example of an ink jet recording apparatus for implementing an ink jet recording method of the present invention.
Figure 1B:
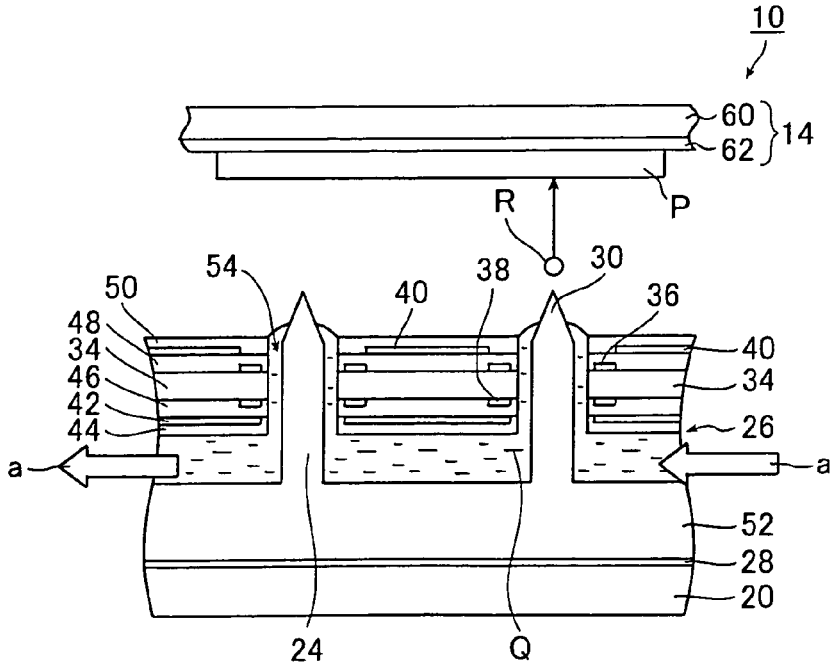

FIGS. 1A and 1B show conceptually an example of an electrostatic ink jet recording apparatus for implementing the ink jet recording method of the present invention. FIG. 1A is a (partial cross-sectional) perspective view, and FIG. 1B is a partial cross-sectional view.

For the sake of facilitating the description, FIGS. 1A and 1B show only one ejection portion and only two ejection portions, respectively, in an ink jet head of a multi channel structure in which multiple ejection portions are arranged two-dimensionally as shown in FIGS. 2A to 2D.

An ink jet recording apparatus (hereinafter, referred to as a recording apparatus) 10 shown in FIGS. 1A and 1B includes an ink jet head (hereinafter referred to as a head) 12, holding means 14 of a recording medium P, and a charging unit 16. In the recording apparatus 10, after the recording medium P is charged to a bias electric potential by the charging unit 16, the head 12 and the holding means 14 are moved relatively under the condition that the head 12 is opposed to the recording medium P, and each ejection portion of the head 12 is driven by modulation in accordance with an image to be recorded to eject ink droplets R on demand, whereby an intended image is recorded on the recording medium P.

An ink composition (ink Q) used in the ink jet recording apparatus of this embodiment is obtained by dispersing charged fine particles which contain a colorant (hereinafter referred to as colorant particles) in a dispersion medium (carrier liquid). The ink composition (ink) will be described later in detail.

The head 12 is an electrostatic ink jet head for allowing an electrostatic force to act on the ink Q thereby ejecting ink droplets R. The head 12 includes a head substrate 20, an ejection port substrate 22 and ink guides 24.

Furthermore, the head substrate 20 and the ejection port substrate 22 are opposed to each other at a predetermined distance, and an ink flow path 26 for supplying the ink Q to each ejection port is formed therebetween. The ink Q contains colorant particles charged in the same polarity as that of a control voltage to be applied to first ejection electrodes 36 and second ejection electrodes 38. During recording, the ink Q is circulated in the ink flow path 26 at a predetermined speed (e.g., ink flow of 200 mm/s) in a predetermined direction.

The head substrate 20 is a sheet-shaped insulating substrate common to all the ejection portions, and a floating conductive plate 28 in an electrically floating state is provided on the surface of the head substrate 20.

In the floating conductive plate 28, an induced voltage induced in accordance with a voltage value of the control voltage to be applied to the control electrodes of the ejection portions (described later) is generated during recording of an image. Furthermore, a voltage value of the induced voltage automatically varies in accordance with the number of operation channels. Owing to the induced voltage, the colorant particles in the ink Q flowing in the ink flow path 26 are urged to migrate to the ejection port substrate 22 side. That is, ink in ejection ports 54 (described later) is concentrated more appropriately.

The floating conductive plate 28 is not an indispensable component but is preferably provided as appropriate. Furthermore, the floating conductive plate 28 should be disposed on the head substrate 20 side of the ink flow path 26, and for example, may be disposed in the head substrate 20. Further, it is preferable that the floating conductive plate 28 be disposed on an upstream side of the ink flow path 26 with respect to the position where the ejection portions are placed. Furthermore, a predetermined voltage may be applied to the floating conductive plate 28.

On the other hand, the ejection port substrate 22 is a sheet-shaped insulating substrate common to all the ejection portions like the head substrate 20. The ejection port substrate 22 includes an insulating substrate 34, the first ejection electrodes 36, the second ejection electrodes 38, a guard electrode 40, a shielding electrode 42 and insulating layers 44, 46, 48 and 50. Furthermore, the ejection ports 54 for the ink Q are formed in the ejection port substrate 22 at positions corresponding to the respective ink guides 24.

As described above, the ejection port substrate 22 is placed at a distance from the head substrate 20, and the ink flow path 26 is formed therebetween.

The first ejection electrodes 36 and the second ejection electrodes 38 are circular electrodes provided in a ring shape on the upper surface and the lower surface of the insulating substrate 34 so as to surround the ejection ports 54 corresponding to the respective ejection portions. The upper surfaces of the insulating substrate 34 and the first ejection electrodes 36 are covered with the insulating layer 48 for protecting and flattening the surfaces, and similarly, the lower surfaces of the insulating substrate 34 and the second ejection electrodes 38 are covered with the insulating layer 46 for flattening the surfaces.

The first ejection electrodes 36 and the second ejection electrodes 38 are not limited to the circular electrodes in a ring shape. As long as they are disposed so as to be adjacent to the ink guides 24, electrodes in any shape such as substantially circular electrodes, divided circular electrodes, parallel electrodes, and substantially parallel electrodes can be used.

Figure 2A:
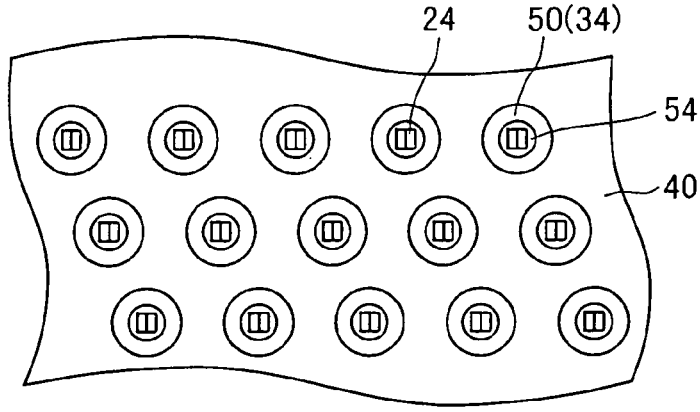
FIGS. 2A to 2D are conceptual views illustrating control electrodes of the ink jet recording apparatus shown in FIGS. 1A and 1B.

As shown in FIG. 2A, in the head 12, the respective ejection portions composed of the ink guides 24, the first ejection electrodes 36, the second ejection electrodes 38, the ejection ports 54, and the like are arranged two-dimensionally in a matrix.

Figure 2B:
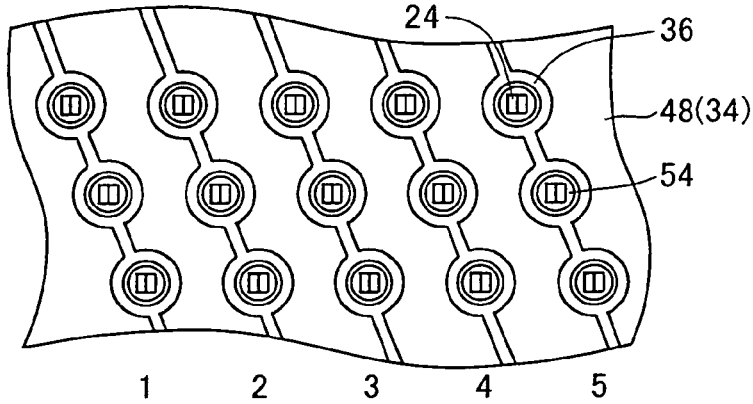

As shown in FIG. 2B, the head 12 has ejection portions arranged in 3 rows (A-row, B-row, C-row) in a column direction (main scanning direction). FIGS. 2A to 2D show that 15 ejection portions are arranged in a matrix in 3 rows (A-row, B-row, C-row) in a column direction (main scanning direction) and 5 columns (1-column, 2-column, 3-column, 4-column, 5-column) in a row direction (sub-scanning direction).

Figure 2C:
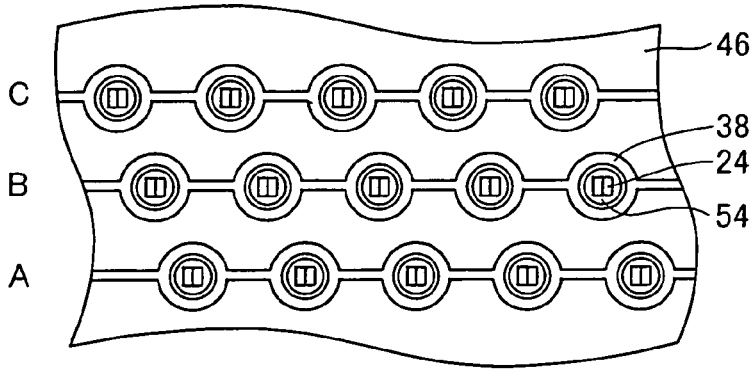

As shown in FIG. 2B, the first ejection electrodes 36 of the ejection portions arranged in the same column are connected to each other. Furthermore, as shown in FIG. 2C, the second ejection electrodes 38 of the ejection portions arranged in the same row are connected to each other.

Furthermore, although not shown, the first ejection electrodes 36 and the second ejection electrodes 38 are respectively connected to the pulse power sources for outputting a pulse voltage for ejecting the ink droplets R (driving each electrode).

The ejection portions in each row are arranged at predetermined intervals in the row direction.

Furthermore, the ejection portions in the B-row are arranged at a predetermined distance in the column direction from the ejection portions in the A-row, and positioned between the ejection portions in the A-row and the ejection portions in the C-row in the row direction. Similarly, the ejection portions in the C-row are arranged at a predetermined distance in the column direction from 5 ejection portions in the B-row, and positioned in the row direction between the ejection portions in the B-row and the ejection portions in the A-row.

Thus, by placing the ejection portions included in the respective rows A, B, and C so that they are shifted in the row direction, one row for recording on the recording medium P is divided into three groups in the row direction.

During recording of an image, the first ejection electrodes 36 disposed in the same column are driven simultaneously at the same voltage level. Similarly, five second ejection electrodes 38 disposed in the same row are driven simultaneously at the same voltage level.

Furthermore, one row for recording on the recording medium P is divided in the row direction into three groups corresponding to the number of rows of the second ejection electrodes 38, whereby sequential driving in time division is performed. For example, in the case shown in FIGS. 2A to 2D, by sequentially recording in the A-row, the B-row, and the C-row of the second ejection electrodes 38 at a predetermined timing, one row of an image can be recorded on the recording medium P. Furthermore, in synchronization with this, the first ejection electrodes 36 are driven by pulse modulation in accordance with image data (image to be recorded), and the ejection of the ink droplets R is turned ON/OFF, whereby an image is recorded.

Thus, in the illustrated example, an image is recorded while the recording medium P and the head 12 are moved relatively in the column direction (main scanning direction), whereby an image can be recorded at a recording density that is three times as high as that of each row in the row direction (sub-scanning direction).

The control electrodes are not limited to a two-layered electrode structure composed of the first ejection electrodes 36 and the second ejection electrodes 38. They may have a single-layered electrode structure or a three or more layered electrode structure.

The guard electrode 40 is a sheet-shaped electrode common to all the ejection portions. As shown in FIG. 2A, portions corresponding to the first ejection electrodes 36 and the second ejection electrodes 38 formed on the circumferences of the ejection ports 54 of the respective ejection portions are opened in a ring shape. Furthermore, the upper surfaces of the insulating layer 48 and the guard electrode 40 are covered with the insulating layer 50 for protecting and flattening the surfaces. A predetermined voltage is applied to the guard electrode 40, which plays a role of suppressing the interference of an electric field generated between the ink guides 24 of the adjacent ejection portions.

Figure 2D:
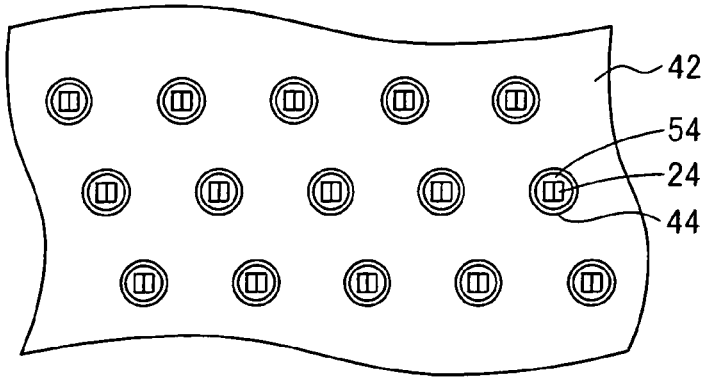

The shield electrode 42 provided on the ink flow path 26 side of the insulating layer 46 is also a sheet-shaped electrode common to all the ejection portions. As shown in FIG. 2D, the shield electrode 42 extends to the portions corresponding to the inside diameters of the first ejection electrodes 36 and the second ejection electrodes 38 formed on the circumferences of the ejection ports 54 of the respective ejection portions. The surface of the shield electrode 42 on the ink flow path 26 side is coated with the insulating layer 44 which protects and flattens the surface of the shield electrode 42. The shield electrode 42 blocks a repulsion electric field from the first ejection electrodes 36 or the second ejection electrodes 38 to the ink flow path 26.

The guard electrode 40 and the shield electrode 42 are preferably disposed, although they are not essential components.

The ink guide 24 is a flat plate made of ceramic with a predetermined thickness having a convex tip end portion 30. In the illustrated example, the ink guides 24 of the ejection portions in the same row are arranged at predetermined intervals on the same support 52 placed on the floating conductive plate 28 on the head substrate 20. The ink guides 24 pass through the ejection ports 54 formed in the ejection port substrate 22 so that the tip end portions 30 protrude upward from an outermost surface (upper surface of the insulating layer 50 in FIG. 1A) on the recording medium P side of the ejection port substrate 22.

The tip end portions 30 of the ink guides 24 are molded in a substantially triangular shape (or a trapezoidal shape) that is tapered gradually toward the holding means 14 of the recording medium P.

It is preferable that a metal be vapor-deposited onto the tip end portions (endmost portions) 30. Although the vapor deposition of the metal onto the tip end portions 30 is not an indispensable element, it substantially increases the dielectric constants of the tip end portions 30, and makes it easy to generate a strong electric field.

There is no particular limit to the shapes of the ink guides 24, as long as the colorant particles in the ink Q are allowed to migrate toward the tip end portions 30 (that is, the ink Q is concentrated). For example, the tip end portions 30 may be varied to an arbitrary shape (e.g., it may not be convex). Furthermore, in order to promote the concentration of ink, slits serving as ink guide grooves for guiding the ink Q to the tip end portions 30 by virtue of a capillary phenomenon may be formed in the central portions of the ink guides 24 in the top-bottom direction on the paper plane of FIG. 1A.

The head 12 may be a so-called line head having a line of ejection portions corresponding to the entire area of one side of the recording medium P or a so-called shuttle type head in which the scanning by the head 12 is performed in combination with the intermittent transport of the recording medium P.

The holding means 14 of the recording medium P has an electrode substrate 60 and an insulating sheet 62, and is placed at a predetermined distance (e.g., 200 to 1000 μm) from the tip end portions 30 of the ink guides 24 so as to be opposed to the head 12.

The electrode substrate 60 is grounded, and the insulating sheet 62 is placed on the surface of the electrode substrate 60 on the ink guide 24 side. During recording, the recording medium P is held on the surface of the insulating sheet 62, that is, the holding means 14 (insulating sheet 62) functions as a platen for the recording medium P.

The charging unit 16 includes a scorotron charger 70 for charging the recording medium P to a negative high voltage and a bias voltage source 72 for supplying a negative high voltage to the scorotron charger 70.

The scorotron charger 70 is placed at a predetermined distance from the recording medium P so as to be opposed to the surface of the recording medium P. Furthermore, the terminal on a negative side of the bias voltage source 72 is connected to the scorotron charger 70, and the terminal on a positive side thereof is grounded.

The charging means of the charging unit 16 is not limited to the scorotron charger 70, and various kinds of known charging means such as a corotron charger and a solid-state charger can be used.

During recording of an image, the surface of the insulating sheet 62 or the recording medium P is charged to a predetermined negative high voltage (e.g., −1,500 V) opposite in polarity to that of a high voltage to be applied to the first ejection electrodes 36 and the second ejection electrodes 38. Consequently, the recording medium P is biased to a negative high voltage with respect to the first ejection electrodes 36 or the second ejection electrodes 38, and is electrostatically attracted to the insulating sheet 62 of the holding means 14.

More specifically, in the illustrated recording apparatus 10, the recording medium P functions as a counter electrode in electrostatic ink jet recording.

In this embodiment, the holding means 14 is composed of the electrode substrate 60 and the insulating sheet 62, and the recording medium P is charged to a negative high voltage by the charging unit 16 to allow the recording medium P to be electrostatically attracted to the surface of the insulating sheet 62. However, the present invention is not limited thereto. The holding means 14 may be composed only of the electrode substrate 60, and the holding means 14 (electrode substrate 60) may be connected to the bias power source 72 to be always biased to a negative high voltage, whereby the recording medium P is electrostatically attracted to the surface of the electrode substrate 60.

Furthermore, the electrostatic attraction of the recording medium P to the holding means 14, and the application of a negative high bias voltage to the recording medium P or the application of a negative high bias voltage to the holding means 14 may be performed with separate negative high voltage sources, and the method of supporting the recording medium P by the holding means 14 is not limited to the electrostatic attraction of the recording medium P, and other supporting methods and supporting means may be used.

The head 12 in the illustrated example has the first and second ejection electrodes 36 and 38. When the pulse voltages are applied to both the first and second ejection electrodes 36 and 38, respectively (both the first and second ejection electrodes 36 and 38 are driven), the ink droplets R are ejected.

As described above, the second ejection electrodes 38 are sequentially set at a high voltage level (e.g., at 400 to 600 V) or in a high impedance state (in an ON state) row by row at a predetermined timing. All the remaining second ejection electrodes 38 are driven at the ground level (the ground state, i.e., in an OFF state). On the other hand, the first ejection electrodes 36 are simultaneously driven on a column basis at a high voltage level or at the ground level in accordance with image data. As a result, the ejection/non-ejection of the ink in each of the ejection portions is controlled.

That is, when the second ejection electrodes 38 are at the high voltage level or in the high impedance state, and the first ejection electrodes 36 are at a high voltage level, the ink Q is ejected in the form of the ink droplet R. When the first ejection electrodes 36 or the second ejection electrodes 38, or both are at the ground level, no ink is ejected.

Then, the ink droplets R ejected from the respective ejection portions are attracted to the recording medium P charged to a negative high voltage and adhere to the recording medium P at predetermined positions to form an image.

Under these circumstances, the drive frequency for the control electrode for ejection of the ink droplet R becomes a drive frequency for the first ejection electrode 36 as described above.

As described above, when the rows of the second ejection electrodes 38 as the lower layer are sequentially turned ON, and the first ejection electrodes 36 as the upper layer are turned ON/OFF in accordance with image data, the first ejection electrodes 36 are driven in accordance with the image data. Thus, when the individual ejection portions in the column direction are supposed to be the centers, in the ejection portions on both the sides of each central ejection portion, the levels of the first ejection electrodes 36 are changed frequently to the high voltage level or to the ground level. In this case, the guard electrode 40 is biased at a predetermined guard potential, e.g., at the ground level in recording an image, thereby excluding influences of electric fields of the adjacent ejection portions.

In addition, in the head 12 in the illustrated example, as another embodiment, the first and second ejection electrodes 36 and 38 can also be driven in opposite states. That is, the first ejection electrodes 36 can be sequentially driven column by column, and the second ejection electrodes 38 can be driven in accordance with the image data.

In this case, with respect to the column direction, the first ejection electrodes 36 are driven column by column, and when the individual ejection portions in the column direction are supposed to be the centers, the first ejection electrodes 36 of the ejection portions on both the sides of each central ejection portion in the column direction usually are at the ground level. Thus, the first ejection electrodes 36 of the ejection portions on both the sides of each central ejection portion in the column direction function as the guard electrode 40. In the case where the first ejection electrodes 36 as the upper layer are sequentially turned ON column by column, and the second ejection electrodes 38 as the lower layer are driven in accordance with the image data, even if no guard electrode 40 is provided, the influences of the adjacent ejection portions can be excluded to enhance the recording quality.

In the head 12, whether the control for the ejection/non-ejection of the ink is carried out using one or both of the first ejection electrodes 36 and the second ejection electrodes 38 is not a limiting factor at all. That is, the voltages of the control electrode side and the recording medium P side only have to be suitably set so that when a difference between the voltage value on the control electrode side during the ejection/non-ejection of the ink and the voltage value on the recording medium P side is larger than a predetermined value, the ink is ejected, while when the difference is smaller than the predetermined value, no ink is ejected.

In addition, while in this embodiment, the colorant particles in the ink are positively charged, and the recording medium P side is charged to a negative high voltage, the present invention is not limited thereto. That is, conversely, the colorant particles in the ink may be negatively charged, and the recording medium P side may be charged to a positive high voltage. When the polarity of the colorant particles is thus reversed to that of the colorant particles in the above-mentioned embodiment, the polarities of the voltages applied to the charging unit 16 for the recording medium P, and the first and second ejection electrodes 36 and 38 of each of the ejection portions only have to be reversed to those in the above-mentioned embodiment.

An electrostatic ink jet recording method of the present invention will hereinafter be described in detail by making mention of the operation for ejection of the ink droplet R in the recording apparatus 10.

Note that in the following example, the colorant particles dispersed in the ink Q are charged positive, and hence the positive voltages are applied to the corresponding ones of the first ejection electrodes 36 and the corresponding ones of the second ejection electrodes 38, respectively, and also the recording medium P is charged to a negative bias voltage in order to eject the ink droplet R.

In recording an image, the ink Q is circulated through the ink flow path 26 from the right-hand side to the left-hand side in FIG. 1B (in a direction indicated by an arrow a in FIG. 1B) at a predetermined speed by a circulation mechanism for ink (not shown).

On the other hand, the recording medium P is charged to a negative high voltage (e.g., at −1,500 V) by the charging unit 16, and is transported to the back side of the paper in FIGS. 1A and 1B at a predetermined speed by transport means (not shown) while being electrostatically attracted to the insulating sheet 62 of the holding means 14. In other words, the recording medium P is a counter electrode charged to a bias voltage of −1,500 V.

Figure 3A:
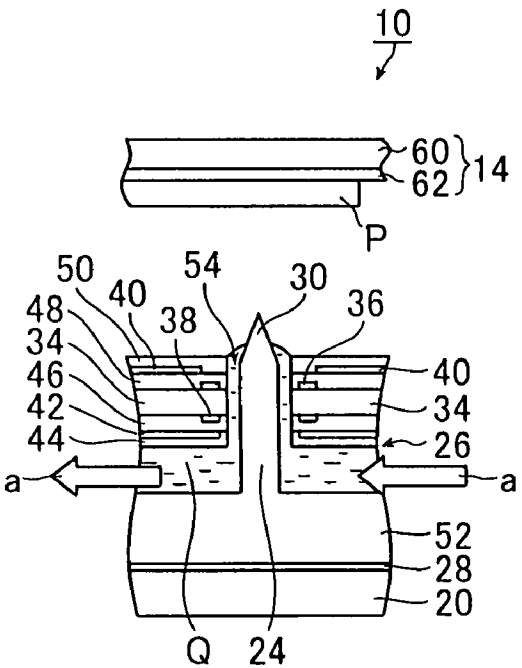
FIGS. 3A to 3C are conceptual views illustrating the ink jet recording method of the present invention.

In the state in which only the bias voltage is applied to the recording medium P, the Coulomb attraction between the bias voltage and the electric charges of the colorant particles of the ink Q, the Coulomb repulsion among the colorant particles, the viscosity of the carrier liquid, the surface tension, the dielectric polarization force and the like act on the ink Q, and these factors operate in conjunction with one another to move the colorant particles and the carrier liquid. Thus, the balance is kept in a meniscus shape as conceptually shown in FIG. 3A in which the ink Q slightly rises from the ejection port 54.

In addition, the Coulomb attraction and the like allow the colorant particles to move toward the recording medium P charged to the bias voltage through a so-called electrophoresis process. That is, the ink Q is concentrated at the meniscus in the ejection port 54.

Under this state, pulse voltages used to eject the ink droplet R are applied (ejection is valid). That is, in the illustrated example, the pulse voltages each falling within a range of about 100 to 600 V are applied from the corresponding pulse power supplies to the first and second ejection electrodes 36 and 38, respectively and the electrodes are driven to perform ejection.

Figure 3B:
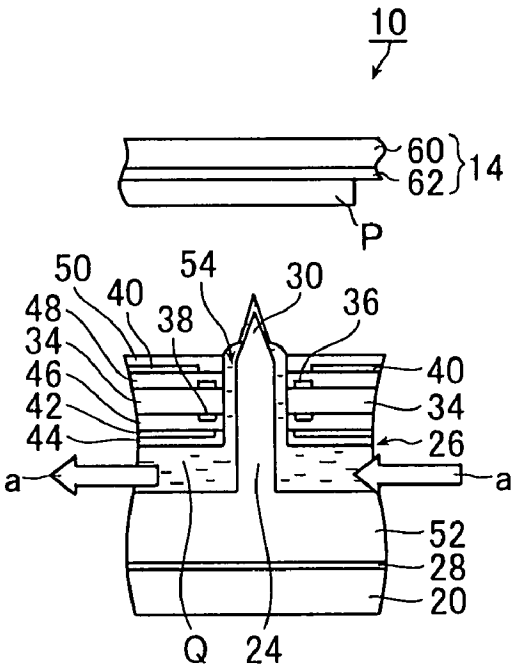

As a result, the pulse voltage is superposed on the bias voltage, and hence the motion occurs in which the previous conjunction motion operates in conjunction with the superposition of the pulse voltage. Thus, the colorant particles and the carrier liquid are attracted toward the bias voltage side (the counter electrode side), i.e., the recording medium P side through the electrophoresis process. As a result, as conceptually shown in FIG. 3B, the meniscus grows to form a nearly conical ink liquid column, i.e., the so-called Taylor cone from the tip portion of the meniscus. In addition, similarly to the foregoing, the colorant particles are moved to the meniscus surface through the electrophoresis process so that the ink Q at the meniscus is concentrated and has a large number of colorant particles at a nearly uniform high concentration.

Figure 3C:
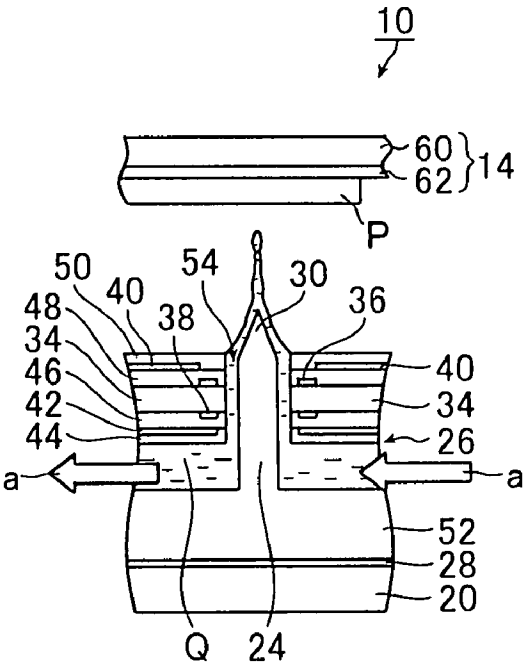
Figure 4:
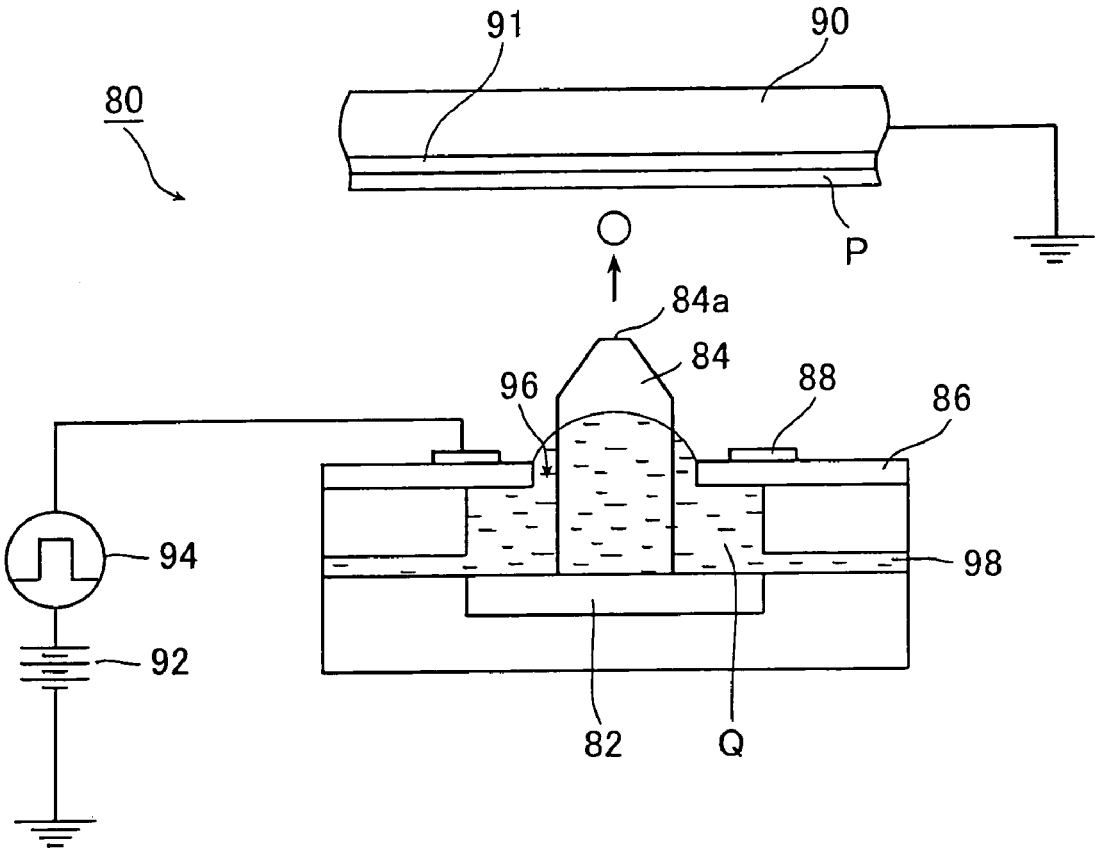
FIG. 4 PRIOR ART
FIG. 4 is a conceptual view illustrating a conventional electrostatic ink jet recording process.

When a finite period of time further elapses after the start of the application of the pulse voltage, the balance mainly between the Coulomb attraction acting on the colorant particles and the surface tension of the carrier liquid is broken at the tip portion of the meniscus having the high electric field strength applied thereto due to the movement of the colorant particles or the like. As a result, the meniscus abruptly grows to form a slender ink liquid column, called the thread, as conceptually shown in FIG. 3C.

When a finite period of time further elapses, the thread is divided into small portions due to the interaction resulting from the growth of the thread, the vibrations generated due to the Rayleigh/Weber instability, the ununiformity in distribution of the colorant particles within the meniscus, the ununiformity in distribution of the electrostatic field applied to the meniscus, and the like. The divided thread is then ejected and flown in the form of the ink droplets R and is attracted by the bias voltage as well to adhere to the recording medium P.

The growth of the thread and its division, and moreover the movement of the colorant particles to the meniscus and/or the thread are continuously generated while the pulse voltages are applied to the first and second ejection electrodes, respectively. In other words, during the formation of the thread, the ink droplets R intermittently fly toward the recording medium P. In addition, at the end of the application of the pulse voltages to the first and second ejection electrodes (ejection is invalid), there is no sufficient force to attract the colorant particles and the carrier liquid to the recording medium P side and the thread formed gets smaller. When a predetermined period of time elapses, the ink Q returns to the state of the meniscus shown in FIG. 3A in which only the bias voltage is applied to the recording medium P.

As is clear from the above, when a pulse voltage (drive voltage) is applied in the electrostatic ink jet recording, a thread is formed and then divided into small portions. Thus, multiple fine ink droplets are ejected to form an image of one dot.

In the ink jet recording method of the present invention, the average concentration of the colorant particles contained in a thread formed by electrostatic ink jet recording using the colorant particles described above but only from its tip end portion to its central portion is made higher than that contained in the whole thread. The central portion of the thread refers to the midpoint between the tip end of the tread and the point corresponding to the tip end of the Taylor cone. The average concentration of the colorant particles contained in the whole thread refers to an average concentration of the colorant particles contained in the thread between its tip end and the point corresponding to the tip end of the Taylor cone. The average concentration of the colorant particles contained in a tread from its tip end portion to its central portion refers to an average concentration of the colorant particles contained in the thread between its tip end and the midpoint.

In another embodiment, the force acting on the colorant particles in the thread is made larger than that obtained by subtracting the force acting on the colorant particles from the force acting on the whole thread (force acting on the carrier liquid). In other words, the following relation is established:

$$F_1 \geq F_2 - F_1$$

where $F_1$ is a force acting on the colorant particles of a thread and $F_2$ is a force acting on the whole thread.

The force acting on the colorant particles is an electrostatic force acting on the charges carried by the colorant particles. Since the carrier liquid is also charged as a whole, the force acting on the whole thread is a force obtained by combining the electrostatic force acting on the colorant particles and the electrostatic force acting on the carrier liquid.

The ink jet recording method of the present invention only requires meeting at least one of the condition that the average concentration of the colorant particles contained in a thread from its tip end portion to its central portion is made higher than that contained in the whole thread, and the condition that the force acting on the colorant particles contained in the thread is made larger than that obtained by subtracting the force acting on the colorant particles contained in the thread from the force acting on the whole thread. However, both the conditions are preferably met.

As described above, the ejection of ink droplets through the formation of threads and their division into small portions is affected by various factors in the ink jet recording method, which may cause variations. Then, the ejection responsivity of the ink droplets with respect to the application of a drive voltage is unstable and the image dots formed have uneven sizes. Therefore, it was difficult to achieve consistent recording of a high-quality and high-resolution image.

In order to solve this problem, the average concentration of the colorant particles contained in a thread from its tip end portion to its central portion is made higher than that contained in the whole thread formed and/or the force acting on the colorant particles in the thread is made larger than that obtained by subtracting the force acting on the colorant particles from the force acting on the whole thread. The force acting on the thread is thus stabilized, which allows a thread to be stably formed and then stably divided into small portions.

As a result, the ejection of ink droplets and hence the control of image dots formed are stabilized, which ensures high-quality and high-resolution recording. In addition, the ejection responsivity of the ink droplets with respect to the control voltage is enhanced, which enables improvement of the drive frequency.

Further, the stabilized ejection of the ink droplets allows the number of ink droplets to be ejected through control of the pulse voltage to be applied to be adjusted, whereby the gradation resolving power can be enhanced.

In the electrostatic ink jet recording using the colorant particles, various factors affect the concentration distribution of colorant particles of threads formed and the force acting on the threads.

The inventor of the present invention has made intensive studies and as a result has found that the ratio of the electric conductivity of the colorant particles to that of the whole ink, the volume mean diameter of the colorant particles, the amount of charge in the colorant particles and the viscosity of the ink greatly affect the concentration distribution of colorant particles of threads formed and the force acting on the threads and by appropriately selecting or setting these elements, the condition that the average concentration of the colorant particles contained in a thread from its tip end portion to its central portion is made higher than that contained in the whole thread, and/or the condition that the force acting on the colorant particles contained in the thread is made larger than that obtained by subtracting the force acting on the colorant particles contained in the thread from the force acting on the whole thread can be met to thereby eject ink droplets.

More specifically, the above conditions can be met by setting the ratio of the electric conductivity of the colorant particles to that of the whole ink (electric conductivity obtained by subtracting the electric conductivity of the supernatant from that of the whole ink) at 50% or higher but lower than 100%, more preferably at 67% or higher but lower than 100%, in other words, by setting the ratio of the electric conductivity of the colorant particles to that of the supernatant obtained by subtracting the electric conductivity of the colorant particles from that of the whole ink at 1 or higher, more preferably at 2 or higher.

The electric conductivities of the whole ink and the colorant particles are calculated as described below.

The electric conductivity of the ink composition at 20° C. was measured using an LCR meter (AG-4311, manufactured by Ando Electric Co., Ltd.) and a liquid electrode (LP-05, manufactured by Kawaguchi Electric Works Co., Ltd.) under the conditions of an applied voltage of 5 V and a frequency of 1 kHz (measurement A). In addition, using a small high-speed cooled centrifuge (SRX-201, manufactured by Tomy Seiko Co., Ltd.), the ink composition was centrifuged at a rotational speed of 14,500 rpm at 20° C. for 30 minutes to precipitate colorant particles, followed by measuring the electric conductivity of the resulting supernatant (measurement B). From the measurement results obtained, the electric conductivity C (i.e., (A−B)) of the colorant particles is calculated.

That is, the above relation is represented by the following expressions:

$$0.5 \leqq (C/A) \leqq 1 \quad \text{(Expression 1)}$$

$$1 \leqq (A/B) \quad \text{(Expression 2)}$$

The above conditions can be also met by setting the volume mean diameter of the colorant particles in a range of 0.2 to 5.0 μm, more preferably 0.4 to 1.5 μm. The particle size has preferably a narrow and uniform distribution.

The volume mean diameter of the colorant particles can be measured by a centrifugal sedimentation method for example using a device such as an ultracentrifugation type device for automatically measuring the particle size distribution (CAPA-700 manufactured by HORIBA LTD.).

The above conditions can be also met by setting the amount of charge in the colorant particles contained in the ink in a range of 5 to 200 μC/g, more preferably 15 to 100 μC/g.

The above conditions can be further met by setting the viscosity of the ink at 20° C. in a range of 0.1 to 10 mPa·s, more preferably 0.6 to 3.0 mPa·s.

The present invention only requires that at least one of the ratio of the electric conductivity of the colorant particles to that of the whole ink, the volume mean diameter of the colorant particles, the amount of charge in the colorant particles, and the viscosity of the ink should fall within the ranges defined above. However, it is preferred that more conditions and more preferably all the conditions fall within the above ranges.

The ink Q (ink composition) used in the recording apparatus 10 will now be described.

As described above, the ink composition is obtained by dispersing charged fine particles which contain a colorant (colorant particles) in a carrier liquid. The ink composition used in the ink jet recording method of the present invention has no other limitation than the above conditions and preferred examples thereof will now be described.

The carrier liquid is preferably a dielectric liquid having a high electric resistivity of particularly $10^{10}$ Ω·cm or more. The use of a carrier liquid having a low electric resistivity is not adequate to the present invention because of electric conduction between the adjoining control electrodes.

Furthermore, the carrier liquid (dielectric liquid) has a dielectric constant of preferably 5 or less, more preferably 4 or less, further preferably 3.5 or less. The dielectric constant of the carrier liquid within the above ranges is preferable because an electric field effectively acts on the charged particles in the carrier liquid.

Preferable examples of the carrier liquid include: linear or branched aliphatic hydrocarbons, alicyclic hydrocarbons, aromatic hydrocarbons, and halogen substitution products of these hydrocarbons; and silicone oil.

For example, hexane, heptane, octane, isooctane, decane, isodecane, decalin, nonane, dodecane, isododecane, cyclohexane, cyclooctane, cyclodecane, toluene, xylene, mesitylene, Isopar C, Isopar E, Isopar G, Isopar H, Isopar L, Isopar M (Isopar: a trade name of EXXON Corporation), Shellsol 70, Shellsol 71 (Shellsol: a trade name of Shell Oil Company), AMSCO OMS, AMSCO 460 solvent (AMSCO: a trade name of Spirits Co., Ltd.), and KF-96L (available from Shin-Etsu Chemical Co., Ltd.) may be used singly or as a mixture of two or more.

The carrier liquid content is preferably 20 to 99 wt % of the entire ink composition. A carrier liquid content of 20 wt % or more allows the colorant particles to be favorably dispersed in the carrier liquid. Besides, as far as the carrier liquid content is 99 wt % or less, the content of colorant particles can be satisfied.

Dyes and pigments, which are well known in the art, can be used as a colorant to be incorporated in the colorant particles and can be selected depending on the purpose and use.

For instance, in terms of the color tone of a print having an image recorded thereon (printed material), pigments can be preferably used (see, for example, "Stabilization of Pigment Dispersion and Surface Treatment Technology and Evaluation" published by Technical Information Institute Co., Ltd., 1st Printing on Dec. 25, 2001, hereinafter, referred to as a "reference"). More specifically, the use of pigments generally used for offset printing ink or proof is favorable because the same color tone as that of a print obtained by offset printing can be obtained.

Further, by altering the colorant to be used, ink of four colors (yellow, magenta, cyan, and black), and also other colored ink can be produced.

Examples of the pigment for the yellow ink include: monoazo pigments such as C.I. Pigment Yellow 1 and C.I. Pigment Yellow 74; disazo pigments such as C.I. Pigment Yellow 12 and C.I. Pigment Yellow 17; non benzidine type azo pigments such as C.I. Pigment Yellow 180; azo lake pigments such as C.I. Pigment Yellow 100; condensed azo pigments such as C.I. Pigment Yellow 95; acid dye lake pigments such as C.I. Pigment Yellow 115; basic dye lake pigments such as C.I. Pigment Yellow 18; anthraquinone type pigments such as Flavanthrone Yellow; isoindolinone pigments such as Isoindolinone Yellow 3RLT; quinophthalone pigments such as Quinophthalone Yellow; isoindoline pigments such as Isoindoline Yellow; nitroso pigments such as C.I. Pigment Yellow 153; metal complex salt azo methine pigments such as C.I. Pigment Yellow 117; and isoindolinone pigments such as C.I. Pigment Yellow 139.

Examples of the pigment for the magenta ink include: monoazo pigments such as C.I. Pigment Red 3; disazo pigments such as C.I. Pigment Red 38; azo lake pigments such as C.I. Pigment Red 53:1 and C.I. Pigment Red 57:1; condensed azo pigments such as C.I. Pigment Red 144; acid dye lake pigments such as C.I. Pigment Red 174; basic dye lake pigments such as C.I. Pigment Red 81; anthraquinone type pigments such as C.I. Pigment Red 177; thioindigo pigments such as C.I. Pigment Red 88; perinone pigments such as C.I. Pigment Red 194; perylene pigments such as C.I. Pigment Red 149; quinacridone pigments such as C.I. Pigment Red 122; isoindolinone pigments such as C.I. Pigment Red 180; and alizarin lake pigments such as C.I. Pigment Red 83.

Examples of the pigment for the cyan ink include: disazo pigments such as C.I. Pigment Blue 25; phthalocyanine pigments such as C.I. Pigment Blue 15; acid dye lake pigments such as C.I. Pigment Blue 24; basic dye lake pigments such as C.I. Pigment Blue 1; anthraquinone type pigments such as C.I. Pigment Blue 60; and alkali blue pigments such as C.I. Pigment Blue 18.

Examples of the pigment for the black ink include: organic and iron oxide pigments such as aniline black type pigments; and carbon black pigments such as Furnace Black, Lamp Black, Acetylene Black, and Channel Black.

Further, suitably applicable typical processed pigments include microlith pigments such as Microlith-A, -K, and -T. Specific examples thereof include Microlith Yellow 4G-A, Microlith Red BP-K, Microlith Blue 4G-T, and Microlith Black C-T.

Further, in addition to the ink of yellow, magenta, cyan and black colors, ink such as white ink using calcium carbonate and a titanium oxide pigment, silver ink using aluminum powder, or gold ink using a copper alloy may be used.

Basically, it is preferable to use one type of pigment for one color in terms of convenience in ink production. Alternatively, for color tint adjustment, two or more kinds of pigments may be mixed together, for example the mixture of carbon black with phthalocyanine for black ink. In addition, the pigments may be used after surface treatment by a conventional procedure, such as rosin treatment (see the reference mentioned above).

The content of the colorant (preferably pigment) is preferably 0.1 to 50 wt % of the entire ink composition. The content of the colorant of 0.1 wt % or more is sufficient for good color development in a print. In addition, the particles containing the colorant can be favorably dispersed in the carrier liquid when the content of the colorant is 50 wt % or less. The content of the colorant is more preferably 1 to 30 wt % of the entire ink composition.

The colorant particles may be prepared by directly dispersing (pulverizing) the colorant such as a pigment in the carrier liquid. Preferably, the colorant particles may be prepared as particles in which the colorant is coated with a coating agent and the particles are then dispersed in the carrier liquid.

Coating the colorant with a coating agent blocks the charges of the colorant itself, so that desirable charging properties can be imparted to the particles. In addition, as the ink composition utilizes the colorant particles having the colorant coated with the coating agent, an image can be more stably fixed by heat fixation with a heat roller or the like after the image has been recorded on a medium (recording medium) by means of electrostatic ink jet recording.

Examples of the coating agent include rosins, rosin modified phenol resin, alkyd resin, (meth)acrylic polymers, polyurethane, polyester, polyamide, polyethylene, polybutadiene, polystyrene, polyvinyl acetate, acetal modified polyvinyl alcohol, and polycarbonate.

Of those, in terms of easiness in particle formation, a preferable polymer has a weight average molecular weight of 2,000 to 1,000,000 and a polydispersity index (weight average molecular weight/number average molecular weight) of 1.0 to 5.0. Furthermore, in terms of easiness in fixation, a preferable polymer has one of a softening point, a glass transition point, and a melting point in the range of 40 to 120° C.

A polymer particularly suitably used as the coating agent is one that contains at least one of the structural units represented by the following general formulas (1) to (4):

GENERAL FORMULA (1)

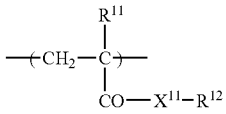

GENERAL FORMULA (2)

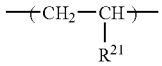

GENERAL FORMULA (3)

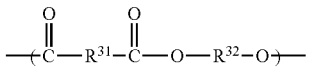

GENERAL FORMULA (4)

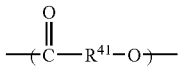

In the above formulas, $X^{11}$ represents an oxygen atom or —$N(R^{13})$—; $R^{11}$ represents a hydrogen atom or a methyl group; $R^{12}$ represents a hydrocarbon group having 1 to 30 carbon atoms; $R^{13}$ represents a hydrogen atom or a hydrocarbon group having 1 to 30 carbon atoms; $R^{21}$ represents a hydrogen atom or a hydrocarbon group having 1 to 20 carbon atoms; $R^{31}$, $R^{32}$, and $R^{41}$ each represent a divalent hydrocarbon group having 1 to 20 carbon atoms. Furthermore, the hydrocarbon groups of $R^{12}$, $R^{21}$, $R^{31}$, $R^{32}$, and $R^{41}$ may respectively contain an ether bond, an amino group, a hydroxy group, or a halogen substituent.

The polymer containing the structural unit represented by the general formula (1) may be obtained by radical polymerization of the corresponding radical polymerizable monomer using any known method.

Examples of the radical polymerizable monomer used include: (meth)acrylates such as methyl (meth)acrylate, ethyl (meth)acrylate, propyl (meth)acrylate, butyl (meth) acrylate, hexyl (meth)acrylate, octyl (meth)acrylate, 2-ethylhexyl (meth)acrylate, dodecyl (meth)acrylate, stearyl (meth)acrylate, cyclohexyl (meth)acrylate, phenyl (meth) acrylate, benzyl (meth)acrylate, and 2-hydroxyethyl (meth) acrylate; and (meth)acrylamides such as N-methyl(meth) acrylamide, N-propyl (meth)acrylamide, N-phenyl(meth) acrylamide, and N,N-dimethyl (meth)acrylamide.

The polymer containing the structural unit represented by the general formula (2) may be obtained by radical polymerization of the corresponding radical polymerizable monomer using any known method.

Examples of the radical polymerizable monomer used include ethylene, propylene, butadiene, styrene, and 4-methylstyrene.

The polymer containing a structural unit represented by the general formula (3) may be obtained by dehydration condensation of the corresponding acid (dicarboxylic acid or acid anhydride) and diol using any known method.

Examples of the dicarboxylic acid and acid anhydride used include succinic anhydride, adipic acid, sebacic acid, isophthalic acid, terephthalic acid, 1,4-phenylene diacetic acid, and diglycolic acid. Further, examples of the diol used include ethylene glycol, 1,2-propanediol, 1,3-propanediol, 1,4-butanediol, 1,6-hexanediol, 1,10-decanediol, 2-butene-1,4-diol, 1,4-cyclohexanediol, 1,4-cyclohexanedimethanol, 1,4-benzenedimethanol, and diethylene glycol.

The polymer that contains the structural unit represented by the general formula (4) can be prepared by dehydration condensation of a carboxylic acid having the corresponding hydroxy group with a known method. Alternatively, the polymer can be prepared by subjecting the cyclic ester of a carboxylic acid having the corresponding hydroxy group to ring-opening polymerization with the known method.

Examples of the carboxylic acid having the corresponding hydroxy group used or the cyclic ester thereof include 6-hydroxyhexanoic acid, 11-hydroxyundecanoic acid, hydroxybenzoic acid, and α-caprolactone.

The polymer that contains at least one of the structural units represented by the general formulas (1) to (4) may be a homopolymer having the structural unit represented by one of the general formulas (1) to (4) or may be a copolymer with another structural component. Beside, those polymers may be singly used as a coating agent or two or more kinds of the polymers may be used in combination.

The coating agent content is preferably 0.1 to 40 wt % of the entire ink composition. The content of the coating agent of 0.1 wt % or more is sufficient for good fixability. In addition, the colorant particles in which the colorant is coated with the coating agent can be favorably formed when the content of the coating agent is 40 wt % or less.

The ink composition is prepared by dispersing (pulverizing) the colorant particles described above in the carrier liquid. It is further preferable to use a dispersant for controlling the particle size of colorant particles and inhibiting the sedimentation of the colorant particles in the composition.

Favorable dispersants include surfactants typified by sorbitan fatty esters such as sorbitan monooleate and polyethylene glycol fatty esters such as polyoxyethylene distearate. In addition, the dispersants also include: a styrene/maleic acid copolymer and an amine-modified product thereof; a styrene/(meta)acrylic compound copolymer; a (meta)acrylic polymer; a polyethylene/(meta)acrylic compound copolymer; rosin; BYK-160, 162, 164, and 182 (polyurethane polymers manufactured by BYK Chemie Co., Ltd.); EFKA-401 and 402 (acrylic polymers manufactured by EFKA Co., Ltd.); and Solsperse 17000 and 24000 (polyester polymers manufactured by Zeneca Ag Products, Inc.). In terms of long-storage stability of the ink composition, the dispersant is preferably a polymer having a weight average molecular weight of 1,000 to 1,000,000 and a polydispersity index (weight average molecular weight/number average molecular weight) of 1.0 to 7.0. Furthermore, most preferable is to use a graft polymer or a block polymer.

The polymer particularly favorably used as the dispersant is a graft polymer containing at least a polymer component made of at least one of the structural units represented by the general formulas (5) and (6) described below and a polymer component containing at least a structural unit represented by the general formula (7) described below as a graft chain.

GENERAL FORMULA (5)

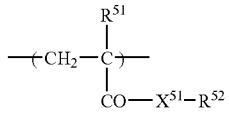

GENERAL FORMULA (6)

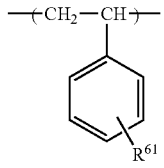

GENERAL FORMULA (7)

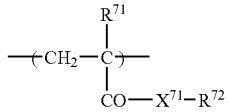

In the above formulas, $X^{51}$ represents an oxygen atom or —N($R^{53}$)—; $R^{51}$ represents a hydrogen atom or a methyl group; $R^{52}$ represents a hydrocarbon group having 1 to 10 carbon atoms; $R^{53}$ represents a hydrogen atom or a hydrocarbon group having 1 to 10 carbon atoms; $R^{61}$ represents a hydrogen atom, a hydrocarbon group having 1 to 20 carbon atoms, a halogen atom, a hydroxyl group, or an alkoxy group having 1 to 20 carbon atoms; $X^{71}$ represents an oxygen atom or —N($R^{73}$)—; $R^{71}$ represents a hydrogen atom or a methyl group; $R^{72}$ represents a hydrocarbon group having 4 to 30 carbon atoms; and $R^{73}$ represents a hydrogen atom or a hydrocarbon group having 1 to 30 carbon atoms. Furthermore, the hydrocarbon groups of $R^{52}$ and $R^{72}$ may respectively contain an ether bond, an amino group, a hydroxy group, or a halogen substituent.

The above graft polymer can be prepared by: polymerizing radical polymerizable monomers corresponding to the general formula (7); introducing a polymerizable functional group to the end of the obtained polymer; and copolymerizing the polymer with a radical polymerizable monomer corresponding to the general formula (5) or (6). Alternatively, the polymerization of the radical polymerizable monomer corresponding to the general formula (7) is preferably carried out in the presence of a chain transfer agent.

Examples of the radical polymerizable monomer corresponding to the general formula (5) include (meth)acrylates such as methyl (meth)acrylate, ethyl (meth)acrylate, propyl (meth)acrylate, butyl (meth)acrylate, hexyl (meth)acrylate, cyclohexyl (meth)acrylate, phenyl (meth)acrylate, benzyl (meth)acrylate, and 2-hydroxyethyl (meth)acrylate; and (meth)acrylamides such as N-methyl(meth)acrylamide, N-propyl (meth)acrylamide, N-phenyl(meth)acrylamide, and N,N-dimethyl (meth)acrylamide.

Examples of the radical polymerizable monomer corresponding to the general formula (6) include styrene, 4-methylstyrene, chlorostyrene, and methoxystyrene.

Further, examples of the radical polymerizable monomer corresponding to the general formula (7) include hexyl (meth)acrylate, octyl (meth)acrylate, 2-ethylhexyl (meth) acrylate, dodecyl (meth)acrylate, and stearyl (meth)acrylate.

Specific examples of the graft polymer include polymers represented by the following structural formulas.

[BZ-1]

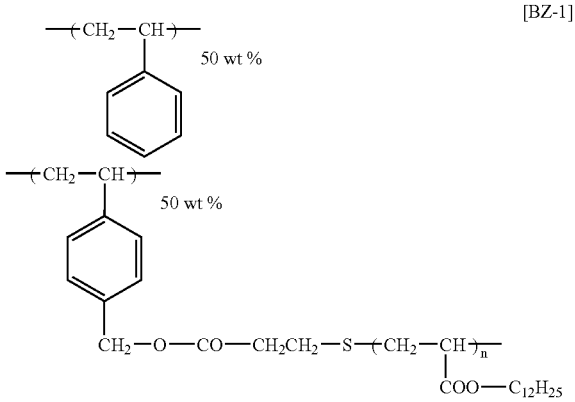

[BZ-2]

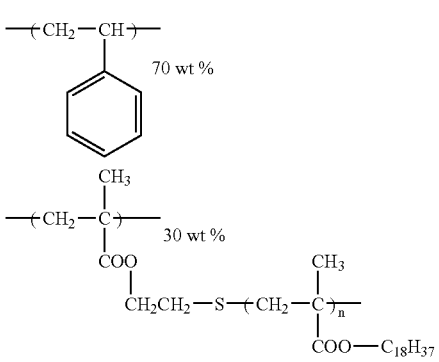

[BZ-3]

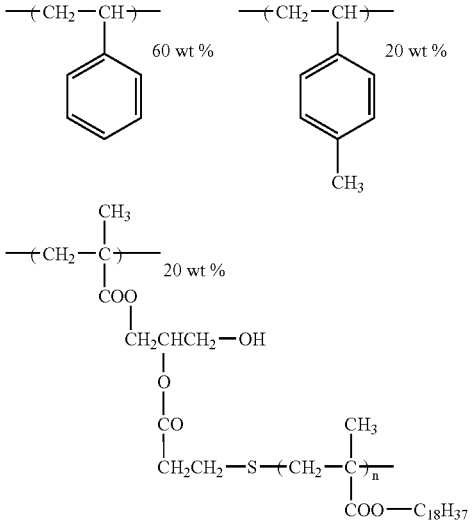

-continued

[BZ-4]

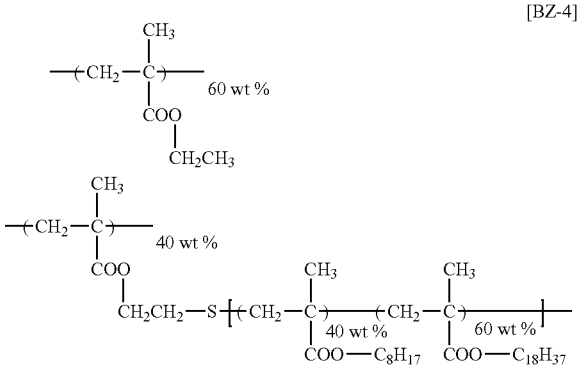

[BZ-5]

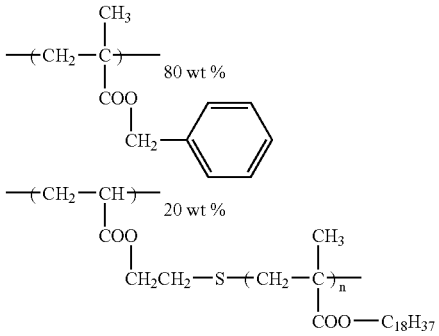

[BZ-6]

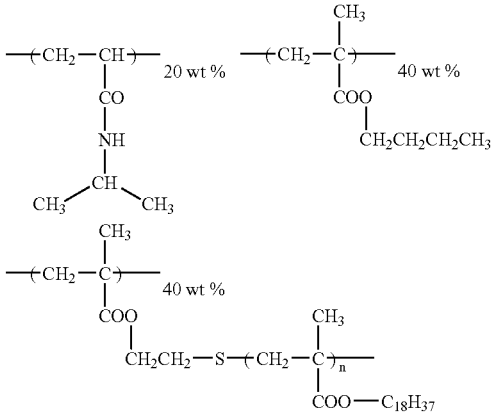

A graft polymer containing a polymer component containing at least one of the structural units represented by the general formulas (5) and (6) and a polymer component containing at least the structural unit represented by the general formula (7) as a graft chain may only contain the structural unit represented by the general formula (5) and/or (6) and the structural unit represented by the general formula (7), or may additionally contain other structural components. A preferable composition ratio between the polymer component containing the graft chain and other polymer components is 10:90 to 90:10. This range is preferable because favorable particle formability can be obtained and a desired particle size can be easily obtained.

Those polymers may be singly used as a dispersant or two or more kinds of the polymers may be used in combination.

The dispersant content is preferably 0.01 to 30 wt % of the entire ink composition. As far as the dispersant content is within the range, favorable particle formability can be obtained and the colorant can have a desired particle size.

The mixture of a colorant and a coating agent is preferably dispersed (pulverized) in a carrier liquid using a dispersant and a charging control agent is more preferably used in combination in order to control the amount of charge in the particles.

Suitable examples of the charging control agent include: metallic salts of organic carboxylic acids such as naphthenic acid zirconium salt and octenoic acid zirconium salt; ammonium salts of organic carboxylic acids such as stearic acid tetramethylammonium salt; metallic salts of organic sulfonic acids such as dodecylbenzenesulfonic acid sodium salt and dioctylsulfosuccinic acid magnesium salt; ammonium salts of organic sulfonic acids such as toluenesulfonic acid tetrabutyl ammonium salt; polymers each containing a carboxylic acid group in the side chain such as a polymer with a carboxylic acid group containing a copolymer of styrene and maleic anhydride modified by amine; polymers each containing a carboxylic acid anion group in the side chain such as a copolymer of stearyl methacrylate and a tetramethylammonium salt of methacrylic acid; polymers each containing a nitrogen atom in the side chain such as a copolymer of styrene and vinylpyridine; and polymers each containing an ammonium group in the side chain such as a copolymer of butyl methacrylate and N-(2-methacryloyloxyethyl)-N,N,N-trimethylammonium tosylate salt.

The charging control agent is preferably a high molecular compound, particularly a high molecular compound that contains a carboxylic acid group.

Of those, one particularly preferable example of the charging control agent is a high molecular compound having a semi-maleic acid amide component and a maleic imide component as repeating units, which is obtained by a reaction between a primary amino compound and a copolymer having at least one or more monomers soluble in a non-aqueous solvent and maleic anhydride as structural units. In addition, another particularly preferable example of the charging control agent is a high molecular compound having a semi-maleic acid amide component and a maleic imide component as repeating units, which is obtained by a reaction between primary and secondary amino compounds and a copolymer having at least one or more monomers soluble in a non-aqueous solvent and maleic anhydride as structural units.

In the high molecular compound used as the charging control agent, examples of a monomer capable of forming a polymer soluble in a non-aqueous solvent include alkenes, cycloalkenes, styrenes, vinyl ethers, allyl ethers, carboxylic acid vinyl esters, carboxylic acid allyl esters, and esters of unsaturated carboxylic acids such as methacrylic acid and acrylic acid, these being all polymerizable.

To explain further, examples of the monomer include: alkenes each having 3 to 40 carbon atoms in total which may be substituted (for example, propenylene, butene, vinylidene chloride, ω-phenyl-1-propene, allyl alcohol, hexene, octene, 2-ethylhexene, decene, dodecene, tetradecene, hexadecene, octadecene, docosene, eicosene, and hexyl 10-undecanoate); cycloalkenes each having 5 to 40 carbon atoms in total (for example, cyclopentene, cyclohexene, bicyclo[2,2,1]-heptene-2, and 5-cyanobicyclo[2,2,1]-heptene-2); styrenes each having 8 to 40 carbon atoms in total which may be substituted (for example, styrene, 4-methylstyrene, 4-n-octylstyrene, and 4-hexyloxystyrene); vinyl ethers and allyl ethers each having 1 to 40 carbon atoms in total substituted by an aliphatic group (examples of the aliphatic group include: alkyl groups which may be substituted (for example, a methyl group, an ethyl group, a butyl group, a hexyl group, an octyl group, a decyl group, a dodecyl group, a hexadecyl group, an octadecyl group, a docosanyl group, a chloroethyl group, a 2-ethylhexyl group, and a 4-methoxybutyl group); aralkyl groups which may be substituted (for example, a benzyl group and a phenethyl group); cycloalkyl groups which may be substituted (for example, a cyclopentyl group and a cyclohexyl group); and alkenyl groups which may be substituted (for example, a 2-pentenyl group, a 4-propyl-2-pentenyl group, an oleyl group, and a linoleyl group); vinyl ethers and allyl ethers each having 6 to 40 carbon atoms in total substituted by an aromatic group (examples of the aromatic group include: a phenyl group, a 4-butoxyphenyl group, and a 4-octylphenyl group); vinyl esters or allyl esters of an aliphatic carboxylic acid having 2 to 40 carbon atoms in total which may be substituted (for example, esters of acetic acid, valeric acid, caproic acid, capric acid, lauric acid, myristic acid, palmitic acid, stearic acid, oleic acid, sorbic acid, and linoleic acid); vinyl esters or allyl esters of an aromatic carboxylic acid having 6 or more carbon atoms in total (for example, esters of benzoic acid, 4-butylbenzoic acid, 2,4-butylbenzoic acid, and 4-hexyloxybenzoic acid); aliphatic group esters of unsaturated carboxylic acids such as acrylic acid, methacrylic acid, maleic acid, and crotonic acid each having 1 to 32 carbon atoms in total which may be substituted (examples of the aliphatic group include a methyl group, an ethyl group, a propyl group, a hexyl group, a decyl group, a 2-hydroxyethyl group, and an N,N-dimethylaminoethyl group).

For the copolymers having those monomers and maleic anhydride as their structural units, favorable specific examples will be represented by the following formulas (1) to (22). However, the present invention is not limited to those examples.

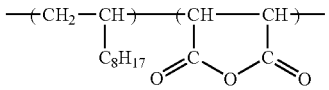
(1)

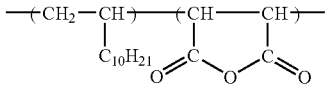
(2)

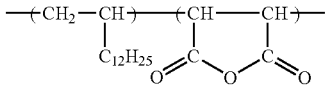
(3)

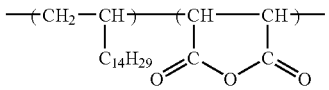
(4)

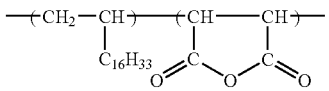
(5)

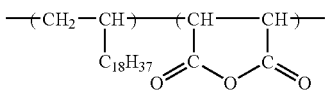
(6)

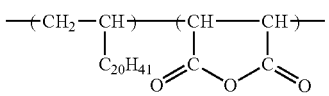
(7)

-continued (8)

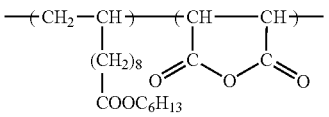

(9)

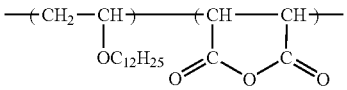

(10)

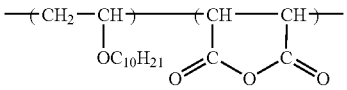

(11)

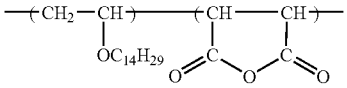

(12)

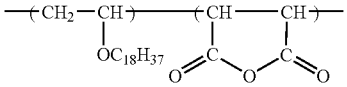

(13)

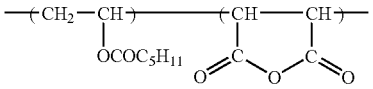

(14)

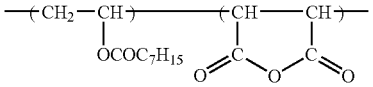

(15)

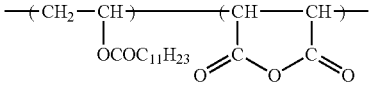

(16)

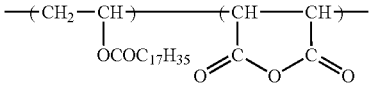

(17)

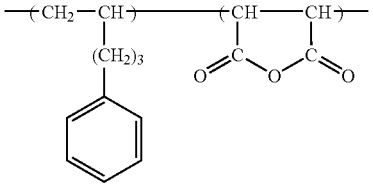

(18)

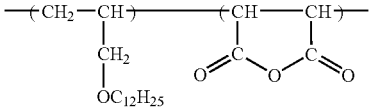

(19)

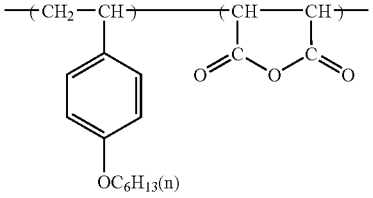

-continued (20)

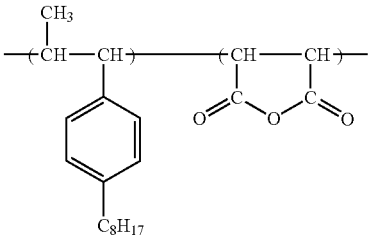

(21)

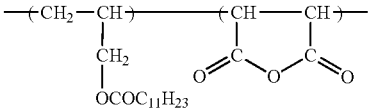

(22)

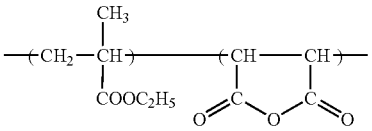

The maleic anhydride-containing copolymer described above can be produced by a conventional known method. For example, the details are described in known publications, such as "Modern Chemical Technology, Volume 16, High-Polymer Industrial Chemistry I(1)", Ryohei Oda Ed., page 281 (published by ASAKURA-SHOTEN, Japan) and the second chapter of "Polymer Handbook 2nd, Edition" (J. Brandrup et al., published by John Wiley & Sons, New York).

The high molecular compound favorably used as the charging control agent is a reactant between the maleic anhydride-containing copolymer and an amino compound.

The amino compound used is a primary amino compound represented by the following general formula (8) or a secondary amino compound represented by the following general formula (9).

$R^{81}NH_2$ General formula (8)

$R^{91}R^{92}NH$ General formula (9)

In the above formulas, $R^{81}$, $R^{91}$, and $R^{92}$ each represent an aliphatic group, an alicyclic hydrocarbon group, an aromatic group, or an heterocyclic group, and in the general formula (9), $R^{91}$ and $R^{92}$ may be identical to or different from each other. Preferable examples thereof include: an alkyl group having 1 to 32 carbon atoms which may be substituted (for example, a methyl group, an ethyl group, a propyl group, a butyl group, a hexyl group, an octyl group, a decyl group, a dodecyl group, a tetradecyl group, a hexadecyl group, an octadecyl group, a docosanyl group, a chloroethyl group, a cyanoethyl group, a 4-butoxypropyl group, a 2-ethylhexyl group, and an N,N-butylaminopropyl group); an alkenyl group having 3 to 32 carbon atoms which may be substituted (for example, an allyl group, a 2-pentenyl group, a 4-propyl-2-pentenyl group, a decenyl group, an oleyl group, and a linoleyl group); an aralkyl group having 7 to 36 carbon atoms which may be substituted (for example, a benzyl group and a phenethyl group); an alicyclic hydrocarbon group having 5 to 32 carbon atoms which may be substituted (for example, a cyclopentyl group, a cyclohexyl group, a bicyclo[2,2,1]-heptyl group, and a cyclohexenyl group); an aryl group having 6 to 38 carbon atoms which may be substituted (for example, a phenyl group, a tolyl group, a 4-butylphenyl group, a 4-decylphenyl group, and a 4-butoxyphenyl group); and a heterocylic group having 5 or more atoms (for example, a furyl group and a thienyl group). For the general formula (9), the rings of $R^{91}$ and $R^{92}$ may be closed with carbon atoms, or may contain hetero atoms (such as a morpholyl group).

Specific examples of a preferable amino compound include: ethylamine, propylamine, butylamine, pentylamine, hexylamine, octylamine, decylamine, dodecylamine, tetradecylamine, hexadecylamine, stearylamine, docosanylamine, 2-ethylhexylamine, 3,3-dimethylpentylamine, allylamine, hexenylamine, dodecenylamine, tetradecenylamine, hexadecenylamine, octadecenylamine, 2-nonyl-2-butenylamine, allylamine, cyclohexylamine, benzylamine, and 4-n-octylaniline.

The high molecular compound as a reactant between the copolymer having the monomer and maleic anhydride as structural units and the amino compound, which can be preferably used as a charging control agent, contains a semi-maleic acid amide component and a maleic imide component.

Such a high molecular compound can be easily produced by: making a semi-maleic acid amide copolymer by a polymer reaction between maleic anhydride in a high molecular compound and a primary amino compound; and carrying out a dehydration ring-closing reaction to convert a part of the semi-maleic acid amide component into a maleic imide component.

More specifically, the respective compounds are mixed in an organic solvent in which the maleic anhydride and the amino compound can be dissolved at a reaction temperature described below without causing the reaction between the maleic anhydride and the amino compound. Examples of the organic solvent include: hydrocarbons such as decane; Isopar G, Isopar H, Shellsol 71, cyclohexane, benzene, toluene, and xylene; ketones such as methylethyl ketone and methylisobutyl ketone; ethers such as dioxane, tetrahydrofuran, and anisole; halogenated hydrocarbons such as chloroform, dichloroethylene, and methyl chloroform; dimethyl formamide; and dimethyl sulfoxide, which can be used singly or in combination.

The reaction mixture is reacted at 60 to 200° C., preferably at 100 to 180° C. for 1 to 80 hours, preferably for 3 to 15 hours. The reaction can be accelerated by using a catalytic amount of an organic base (such as triethyl amine, dimethyl aniline, pyridine, or morpholine), or inorganic or organic acid (such as sulfuric acid, methanesulfonic acid, or benzenesulfonic acid). Alternatively, any typical dehydrating agent (such as phosphorus pentaoxide or dicyclocarboxydiimide) may be used together.

A reactant obtained by the reaction is a high molecular compound that contains a semi-maleic acid amide structure and a maleic amide structure in the high molecular compound as described above. The contents of the semi-maleic acid amide structure and the maleic amide structure are 10:90 to 90:10, preferably 30:70 to 70:30 in weight ratio. The contents of a monomer moiety capable of forming a high molecular compound, which is soluble in a non-aqueous solvent, and a maleic anhydride moiety are 10:90 to 99.5:0.5, preferably 70:30 to 30:70 in weight ratio. The high molecular compound has a molecular weight of 1,000 to 500,000, preferably 5,000 to 50,000.

The electric charges provided from the charging control agent to the colorant particles may be positive or negative.

The content of the charging control agent with respect to the whole ink composition is preferably in a range of 0.0001 to 10 wt %. When the content falls within this range, the electric conductivity of the ink composition can be easily adjusted within a range of 10 nS/m to 300 nS/m. The use of the charging control agent described above makes it possible to easily adjust the electric conductivity of the colorant particles to 50% or higher but lower than 100% of that of the ink composition, and/or the ratio of the electric conductivity of the colorant particles to the value obtained by subtracting the electric conductivity of the colorant particles from that of the ink composition to 1 or higher.

The ink composition used in the ink jet recording method of the present invention may contain not only the aforementioned components such as the carrier liquid, colorant particles, dispersant and charging control agent, but also various other components such as an antiseptic for preventing putrefaction and a surfactant for controlling the surface tension depending on the intended use.

The ink composition can be prepared for example by dispersing colorant particles into a carrier liquid to form particles and adding a charging control agent to the carrier liquid to allow the colorant particles to be charged. The following methods are given as the specific methods.

(1) A method including: previously mixing (kneading) a colorant and/or dispersion resin particles; dispersing the resultant mixture into a carrier liquid using a dispersant when necessary; and adding the charging control agent thereto.

(2) A method including: adding a colorant and/or dispersion resin particles and a dispersant into a carrier liquid at the same time for dispersion; and adding the charging control agent thereto.

(3) A method including adding a colorant and the charging control agent and/or the dispersion resin particles and the dispersant into a carrier liquid at the same time for dispersion.

Methods for adjusting the ratio of the electric conductivity of the colorant particles to that of the whole ink, the volume mean diameter of the colorant particles, amount of charge in the colorant particles and the viscosity of the ink within preferred ranges are illustrated below.

The ratio of the electric conductivity of the colorant particles to that of the whole ink can be adjusted based on the selection of a specific dispersion medium, or by changing singly or in combination the amount of charge in the colorant particles and the content of the charging control agent.

The volume mean diameter of the colorant particles can be adjusted based on the selection of a method for forming particles such as grinding or aggregation method, control of the forming conditions such as the temperature, time, various additives and stirring condition, and the classification of the particles formed.

The amount of charge in the colorant particles can be adjusted by changing the content of the charging control agent or by changing the adsorption efficiency of the charging control agent through control of the surface profile and adsorption properties of the colorant particles.

Further, the viscosity of the ink can be adjusted based on the selection of a specific dispersion medium, or by the concentration of the colorant particles and the use of various concentration adjusting agents.

The ink jet recording method of the present invention may be applied to record a color image or a monochrome image as far as the above conditions are met.

While the ink jet recording method of the present invention has been described above in detail, it is to be understood that the present invention is not limited to the above-mentioned embodiment. Hence various improvements and changes may be made without departing from the gist of the present invention.

Hereinafter, the present invention will be described in more detail with reference to specific examples of the present invention.

The recording apparatus 10 shown in FIGS. 1A and 1B was used to check the average diameter of the image dot and its dispersion while the ratio between the electric conductivities of the colorant particles and the supernatant was changed.

Ink droplets were ejected under the same conditions except that the ratio between the electric conductivities of the colorant particles and the supernatant was changed by changing the content of the charging control agent to be added to the ink.

EXAMPLE 1

The following materials were prepared:

Cyan pigment (colorant) [Phthalocyanine pigment, C. I. Pigment Blue (15:3) (LIONOL BLUE FG-7350, manufactured by Toyo Ink Mfg. Co., Ltd.);

Coating agent [AP-1];

Dispersant [BZ-2];

Charging control agent [CT-1]; and

Carrier liquid: Isopar G (manufactured by EXXON Corporation).

The coating agent [AP-1], the dispersant [BZ-2], and the charging control agent [CT-1] have the following structural formulas:

[AP-1]

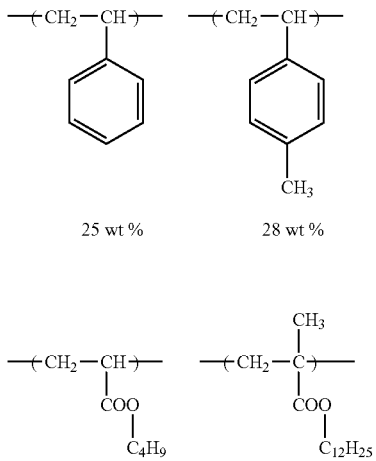

-continued

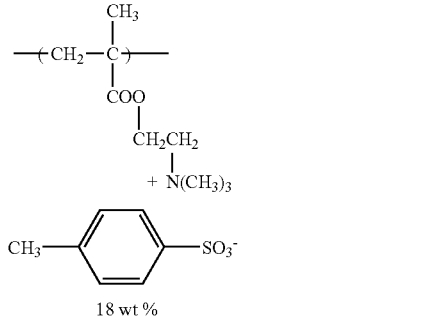

[BZ-2]

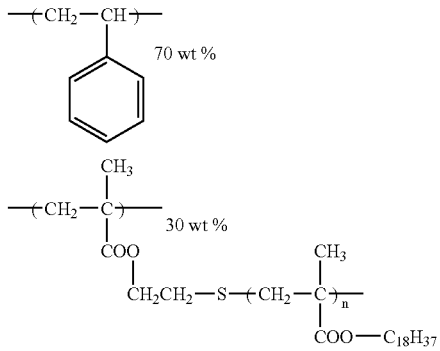

[CT-1]

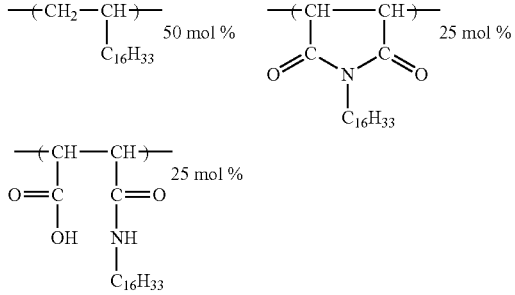

The coating agent [AP-1], the dispersant [BZ-2], and the charging control agent [CT-1] were synthesized as follows.

Coating Agent [AP-1]

Styrene, 4-methyl styrene, butyl acrylate, dodecyl methacrylate, and 2-(N,N-dimethylamino)ethyl methacrylate were radically polymerized using a known polymerization initiator and then reacted with methyl tosylate to obtain AP-1. The resulting AP-1 had a weight average molecular weight of 15,000, a polydispersity index (weight average molecular weight/number average molecular weight) of 2.7, a glass transition point (mid point) of 51° C., and a softening point of 46° C. (employing the strain gage method).

Dispersant [BZ-2]

Stearyl methacrylate was radically polymerized in the presence of 2-mercaptoethanol and was then reacted with methacrylic anhydride to obtain a stearyl methacrylate polymer having a methacryloyl group at its end (a weight average molecular weight of 7,600). Subsequently, the polymer was radically polymerized with styrene to obtain BZ-2. The resulting BZ-2 had a weight average molecular weight of 110,000.

Charging Control Agent [CT-1]

1-hexadecyl amine was reacted with a 1-octadecene/maleic anhydride copolymer to obtain CT-1. The resulting CT-1 had a weight average molecular weight of 17,000.

Using the materials described above, an ink composition containing particles having a cyan colorant was prepared.

At first, 10 g of the cyan pigment and 20 g of the coating agent [AP-1] were placed in a desk-type kneader (PBV-0.1, manufactured by Irie Shokai Co., Ltd.). Then, a heater was set at 100° C. to mix them under heating for 2 hours. Subsequently, 30 g of the resulting mixture was roughly pulverized in a trio blender (manufactured by Trioscience Ltd.) and then finely pulverized by a sample mill (SK-M10, manufactured by Kyoritsu Riko Co., Ltd.).

30 g of the resulting fine pulverized product was subjected to preliminary dispersion in a paint shaker (manufactured by Toyo Seiki Seisaku-Sho, Ltd.) together with 7.5 g of the dispersant [BZ-2], 75 g of Isopar G, and glass beads of about 3.0 mm in diameter. After removal of the glass beads, the mixture was dispersed (pulverized) together with zirconia ceramic beads of about 0.6 mm in diameter in a dyno-mill (Type KDL, manufactured by Shinmaru Enterprises Corp.) at a rotational speed of 2,000 rpm while the inner temperature thereof was kept at 25° C. for 5 hours and then at 45° C. for 5 hours. The zirconia ceramic beads were removed from the resulting dispersion liquid. Then, the dispersion liquid was mixed with 316 g of Isopar G and 0.6 g of the charging control agent [CT-1], resulting in an ink composition [EC-1].

The electric conductivity of the ink composition [EC-1] at 20° C. was measured in the same manner as above using an LCR meter (AG-4311, manufactured by Ando Electric Co., Ltd.) and a liquid electrode (LP-05, manufactured by Kawaguchi Electric Works Co., Ltd.) under the conditions of an applied voltage of 5 V and a frequency of 1 kHz. As a result, the electric conductivity of the whole ink was 100 nS/m. In addition, using a small high-speed cooled centrifuge (SRX-201, manufactured by Tomy Seiko Co., Ltd.), the ink composition was centrifuged at a rotational speed of 14,500 rpm at 20° C. for 30 minutes to precipitate colorant particles, followed by measuring the electric conductivity of the resulting supernatant. As a result, the electric conductivity of the supernatant was 30 nS/m.

In other words, the electric conductivity of the colorant particles is 70 nS/m and the ratio of the electric conductivity of the colorant particles to the electric conductivity of the supernatant is 2.3.

The volume mean diameter of the colorant particles was measured in the same manner as above by a centrifugal sedimentation method using an ultracentrifugation type device for automatically measuring the particle size distribution, CAPA-700 (manufactured by HORIBA LTD.). The volume mean diameter obtained was 0.7 μm.

The viscosity of the ink composition was 1.2 mPa·s.

Ejection of ink droplets was tried using the ink composition [EC-1] in the ink jet recording apparatus 10 shown in FIGS. 1A and 1B. The first ejection electrodes 36 were switched between two states including the ground state (OFF state) and the high impedance state (ON state) and the second ejection electrodes 38 were switched between two states including OV (OFF state) and +600V (ON state). The surface of the recording medium P was charged to a potential of −1600V. The distance between the tip end portion 30 of the ink guide 24 and the recording medium P was set at 500 μm. The ink droplets could be ejected when the first and second ejection electrodes 36 and 38 were both in the ON state.

Multiple dots were formed under the above condition so as not to overlap each other. One thousand dots were selected at random and their equivalent circle diameters were measured using a dot analyzer (DA-6000 manufactured by Oji Scientific Instruments) to record minimum dot diameters. An average of the minimum dot diameters was calculated and further a standard deviation (σ) was calculated and 3σ was determined for the dispersion. As a result of the measurement, the minimum dot diameter of the image dot was 16 μm and the dispersion (3σ) was 5 μm.

COMPARATIVE EXAMPLE 1

Ink was prepared in the same manner except that the amount of the charging control agent [CT-1] added in the ink composition [EC-1] was changed. The electric conductivities of the whole ink and the supernatant were measured as in Example 1. As a result, the electric conductivity of the ink was 200 nS/m and that of the supernatant was 120 nS/m. In other words, the electric conductivity of the colorant particles was 80 nS/m and the ratio of the electric conductivity of the colorant particles to that of the supernatant was 0.7.

Ink was ejected as in Example 1 except that the above ink was used, and image dots were formed in the same manner as in Example 1 and the minimum dot diameter and the dispersion were measured. As a result of the measurement, the minimum diameter of the image dot was 30 μm and the dispersion was 10 μm.

The ink composition used, the electric conductivity of the ink composition, the electric conductivity of the supernatant, the electric conductivity of the colorant particles, the ratio of the electric conductivity of the colorant particles to that of the supernatant, and the measurement results are all shown in Table 1.

TABLE 1

| Ink composition | Example 1 EC-1 | Comparative Example 1 Amount of charging control agent added in EC-1 was changed |
|---|---|---|
| Electric conductivity of ink composition | 100 nS/m | 200 nS/m |
| Electric conductivity of supernatant | 30 nS/m | 120 nS/m |
| Electric conductivity of colorant particles | 70 nS/m | 80 nS/m |
| Ratio of electric conductivity of charged particles to that of supernatant | 2.3 | 0.7 |
| Recorded minimum dot diameter and dispersion | 16 μm +/− 5 μm | 30 μm +/− 10 μm |

As shown in Table 1, the ratio of the electric conductivity of the colorant particles to that of the supernatant is set in a specified range to make the average concentration of the colorant particles contained in a thread from its tip end portion to its central portion higher than that contained in the whole thread and/or to make the force acting on the colorant particles contained in the thread larger than the force obtained by subtracting the force acting on the colorant particles contained in the thread from the force acting on the whole thread, whereby image dots having smaller average diameters can be recorded and the dispersion can be also reduced. In other words, the stability in the ejection repeatedly performed for each dot is high so that even image dots are formed. A high-quality image can be thus recorded in a high resolution.

The above results clearly show the effects of the present invention.

What is claimed is:

1. An ink jet recording method comprising the steps of:

allowing an electrostatic force to act on an ink composition containing at least charged particles containing a colorant and a dispersion medium to form a thread of said ink composition, and dividing the thread into small portions to eject ink droplets on a recording medium, wherein a first average concentration of the charged particles contained in said thread from its tip end portion to its central portion is higher than a second average concentration of the charged particles contained in a whole thread.

2. The ink jet recording method according to claim 1, wherein a first force acting on the charged particles contained in the thread is made larger than a second force obtained by subtracting said first force acting on the charged particles contained in the thread from a second force acting on a whole thread.

3. The ink jet recording method according to claim 1, wherein a first electric conductivity of the charged particles contained in said ink composition is 50% or higher but lower than 100% of a second electric conductivity of said ink composition.

4. The ink jet recording method according to claim 1, wherein a ratio of a first electric conductivity of the charged particles to a value obtained by subtracting the first electric conductivity of the charged particles from a second electric conductivity of said ink composition is 1 or higher.

5. The ink jet recording method according to claim 1, wherein the charged particles contained in said ink composition has a volume mean diameter of 0.2 to 5.0 μm.

6. The ink jet recording method according to claim 1, wherein the charged particles contained in said ink composition has an amount of charge in a range of 5 to 200 μC/g.

7. The ink jet recording method according to claim 1, wherein said ink composition has a viscosity at 20° C. in a range of 0.1 to 10 mPa·s.

8. An ink jet recording method comprising the steps of:

allowing an electrostatic force to act on an ink composition containing at least charged particles containing a colorant and a dispersion medium to form a thread of said ink composition, and dividing the thread into small portions to eject ink droplets on a recording medium, wherein a first force acting on the charged particles contained in the thread is made larger than a second force obtained by subtracting said first force acting on the charged particles contained in the thread from a second force acting on a whole thread.

9. The ink jet recording method according to claim 8, wherein a first electric conductivity of the charged particles contained in said ink composition is 50% or higher but lower than 100% of a second electric conductivity of said ink composition.

10. The ink jet recording method according to claim 8, wherein a ratio of a first electric conductivity of the charged particles to a value obtained by subtracting the first electric conductivity of the charged particles from a second electric conductivity of said ink composition is 1 or higher.

11. The ink jet recording method according to claim 8, wherein the charged particles contained in said ink composition has a volume mean diameter of 0.2 to 5.0 μm.

12. The ink jet recording method according to claim 8, wherein the charged particles contained in said ink composition has an amount of charge in a range of 5 to 200 μC/g.

13. The ink jet recording method according to claim 8, wherein said ink composition has a viscosity at 20° C. in a range of 0.1 to 10 mPa·s.

* * * * *